US006061543A

United States Patent [19]

Kayahara et al.

[11] Patent Number: 6,061,543

[45] Date of Patent: May 9, 2000

[54] IMAGE FORMING APPARATUS WHICH PREVENTS IMAGE QUALITY DETERIORATION DUE TO PLASTIC DEFORMATION

[75] Inventors: Shin Kayahara, Urayasu; Takashi Bisaiji, Yokohama, both of Japan

[73] Assignee: Ricoh Company, Ltd., Japan

[21] Appl. No.: 09/342,654

[22] Filed: Jun. 29, 1999

[30] Foreign Application Priority Data

Jun. 29, 1998 [JP] Japan ..... 10-196523

[51] Int. Cl.[7] ..... G03G 15/01; G03G 15/16

[52] U.S. Cl. ..... 399/302; 399/31; 399/66; 399/298

[58] Field of Search ..... 399/297, 302, 399/308, 313, 66, 298, 312, 9

[56] References Cited

U.S. PATENT DOCUMENTS

| | | | |
|---|---|---|---|
| 4,095,886 | 6/1978 | Koeleman et al. | 399/308 |
| 5,701,566 | 12/1997 | Bisaiji et al. | 399/302 |
| 5,742,888 | 4/1998 | Fuchiwaki et al. | 399/308 |
| 5,873,017 | 2/1999 | Soga et al. | 399/302 |
| 5,887,218 | 3/1999 | Yuu et al. | 399/302 X |

FOREIGN PATENT DOCUMENTS

| | | |
|---|---|---|
| 5-134487 | 5/1993 | Japan . |
| 6-167842 | 6/1994 | Japan . |
| 6-222648 | 8/1994 | Japan . |
| 8-114966 | 5/1996 | Japan . |
| 8-179585 | 7/1996 | Japan . |
| 8-211693 | 8/1996 | Japan . |

*Primary Examiner*—Susan S. Y. Lee
*Attorney, Agent, or Firm*—Graham & James LLP

[57] ABSTRACT

An image forming apparatus has a transfer region located between a first belt and a second belt, which belts are respectively spanned and tensioned around a plurality of rollers. A total length of the first belt is substantially equal to integral multiples of a total length of the second belt. Certain portions of the belts are deformed via plastic deformation caused by contacting the plurality of rollers. The rollers are arranged so that deformed portions of the belts do not overlap each other in the transfer region.

24 Claims, 3 Drawing Sheets

IMAGE FORMING APPARATUS WHICH PREVENTS IMAGE QUALITY DETERIORATION DUE TO PLASTIC DEFORMATION

BACKGROUND OF THE INVENTION

1. Field of the Invention

This invention relates to an image forming apparatus, such as a copying machine, a printer, a facsimile machine, and more particularly, to an apparatus having a combination of belt driving units, in which respective belts are disposed in contact with and tensioned around a plurality of rollers such that the belts are rotated at the same circumferential speed in contact with each other, so as to transfer a toner image from one belt to the other.

2. Discussion of the Related Art

An image forming apparatus such as a copying machine is known to include, for example, an image bearing member for forming an electrostatic latent image, a developing member for developing the electrostatic latent image with toner to form a toner image, a first transfer unit for transferring the toner image thereto, and a second transfer unit. The second transfer unit transfers the toner image from the first transfer unit to a transfer sheet of paper which is fed by the second transfer unit into a second transfer region disposed between the first transfer unit and the second transfer unit.

The first transfer unit and the second transfer unit, which in such an image forming apparatus, include a combination of units arranged to transfer a toner image. The first and second transfer units move in contact with an adjacent mobile unit with the same circumferential speed, and in many cases, each unit includes an endless belt which is spanned and tensioned around a plurality of rollers. In this case, the second transfer unit also operates as a feeding unit for a transfer sheet of paper.

Such a transfer unit having a belt is advantageous in designing the apparatus, because it provides a degree of freedom in designing the configuration of the apparatus. Therefore, a combination of the transfer units having belts, for example, a combination of an image bearing member and a first transfer unit or a combination of a first transfer unit and a second transfer unit, is frequently included and housed in an image forming apparatus.

In such an image forming apparatus having a combination of transfer units having belts as described above, a toner image of the first transfer unit is transferred to the second transfer unit or to a transfer sheet of paper using an electrostatic force in a transfer region, which defines a nip between the belts at which the belts are brought into tight contact each other.

A driving roller, which is one of the plurality of rollers that drives one of the first and second belts, controls rotation of the units having the belt. In this case, a sufficiently high tension is imposed on the belt that is spanned around the plurality of rollers so that the driving force is reliably transmitted from the driving roller to the belt.

During a period of time when the unit including the belt is in a stopped state, the transfer unit is at rest, which causes high-tension to be applied to the above-mentioned belt. If such a high-tension state is applied to the belt for a long period of time, portions of the belt, which are disposed along respective circumferential surfaces of the rollers, may be deformed via plastic deformation. Such plastic deformation is referred to as "the curl tendency". Hereinafter, a portion which is deformed by plastic deformation due to extended contact with the roller is referred to as "a deformed portion."

In the image forming apparatus described above, which includes a combination of transfer units having respective belts which are deformed by plastic deformation, when a deformed portion of the first belt overlaps another deformed portion of the second belt in a transfer region, the capability of transferring the image is deteriorated. This is caused by the inability to maintain tight contact between the belts, which frequently occurs in the transfer region due to the plastic deformation. In particular, the longer the time that the belts and rollers are stopped and at rest, the greater the degree of plastic deformation becomes, which further decreases the tight contact between the belts. Accordingly, the image quality is often deteriorated. For example, when an undesirable micro gap between the combination of belts is generated in the transfer region, occurrence of an unusual discharge through the gap causes greatly decreased image quality.

SUMMARY OF THE INVENTION

To overcome the problems described above, preferred embodiments of the present invention provide a novel image forming apparatus at least having a combination of transfer units including a plurality of belts, which are arranged to prevent image quality deterioration due to plastic deformation of the belts.

According to at least one preferred embodiment of the present invention, an image forming apparatus includes at least a combination of transfer units. Each transfer unit includes a plurality of rollers and a belt. A first belt is spanned and tensioned around the plurality of rollers and is driven at substantially the same circumferential speed as a second belt. The first belt is brought into contact with the second belt in a transfer region, through which a toner image is transferred. The length of the first belt is substantially equal to integral multiples of the second belt. Further, the plurality of rollers that deform portions of the plurality of belts via plastic deformation is disposed so that deformed portions of one belt do not overlap the deformed portions of the other belt in the transfer region.

In another aspect of at least one preferred embodiment of the present invention, each of the belts further includes a detection mark which indicates a datum position of the belt. Each of the transfer units further includes a detector for detecting the detection mark. In addition, the transfer unit is capable of being separated from and being brought into contact with the transfer region, and is further capable of starting/stopping the driving thereof with an independent timing. Each of the belts is controlled so as to stop in the same, predetermined, desired position each time the belts are stopped. Further, the combination of transfer units is controlled so that the deformed portions in the belts, which are formed through contact with the respective rollers during a period of time that the belts are in a standstill state, do not overlap each other in the transfer region.

In yet another aspect of preferred embodiments of the present invention, the combination of transfer units preferably includes an image bearing member and a first transfer unit.

In still another aspect of preferred embodiments of the present invention, the combination of transfer units includes a first transfer unit and a second transfer unit.

The above-mentioned elements, features, characteristics and advantages of the present invention are further clarified by the following detailed description of preferred embodiments referring to the drawings.

BRIEF DESCRIPTION OF THE DRAWINGS

A more complete appreciation of the present invention and many of the attendant advantages thereof will be readily obtained as the same becomes better understood by reference to the following detailed description of preferred embodiments of the present invention, when considered in connection with the accompanying drawings, wherein.

DETAILED DESCRIPTION OF PREFERRED EMBODIMENTS

Figure 1:
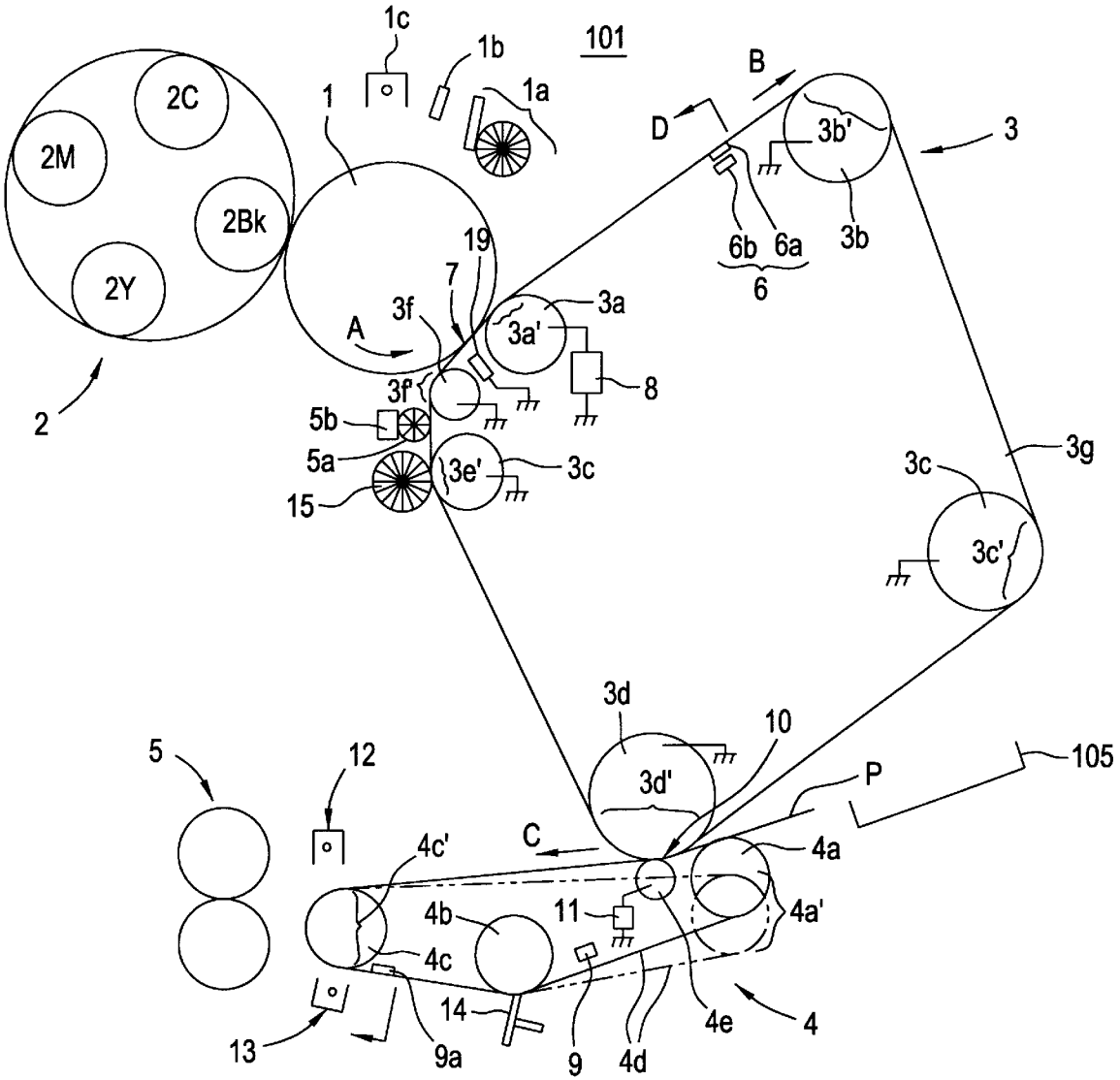
FIG. 1 is a schematic diagram illustrating an image forming apparatus according to a preferred embodiment of the present invention.

Referring now to the drawings, wherein like reference numerals represent identical or corresponding elements, and more particularly referring to FIG. 1 thereof, there is shown a color image forming apparatus according to a preferred embodiment of the present invention.

The color image forming apparatus includes, for example, a color image forming unit 101 (hereinafter referred to as a color printer 101), a color image reading unit (not shown, and hereinafter referred to as a color scanner), a sheet supply unit 105 which accommodates transfer sheets of paper, and a controller unit (not shown) for controlling operations of these and other units.

The color scanner optically reads information of an original image for each spectral component of such as red, green, and blue, and the image signals resolved with respect to the color components are output as electrical signals. Next, the color scanner processes the image signals of respective colors according to a color-conversion procedure on the basis of respective signal intensities. This provides color image data of black (hereinafter abbreviated as Bk), cyan (Hereinafter abbreviated as C), magenta (hereinafter abbreviated as M), and yellow (hereinafter abbreviated as Y) colors.

The color printer 101 includes, for example, a photoconductor 1 preferably in the form of a drum and functioning as an image bearing member, a rotating developer device 2, a first transfer unit 3, a second transfer unit 4, a fixing unit 5, an optical writing unit (not shown), and other elements known to be included in such a color printer.

The photoconductor 1 rotates in a counterclockwise direction as indicated by an arrow A in FIG. 1. A photoconductor cleaning unit 1*a*, a discharge lamp 1*b*, a charger 1*c*, the developer device 2, the first transfer unit 3, and other elements are arranged around the photoconductor 1.

An optical writing device (not shown) is disposed at an upper portion of the photoconductor 1, and emits light signals corresponding to the original image, which are generated on the basis of the image data from the color scanner, in order to write a latent image onto the photoconductor 1. Such a writing unit includes, for example, a laser beam emitter, a polygonal mirror, a f(θ) lens, and a reflective mirror.

The developer device 2 preferably includes four developing devices (a developing device 2Bk for Bk image, a developing device 2C for C image, a developing device 2M for M image and a developing device 2Y for Y image) and a rotating driving unit (not shown) for rotating the whole developer device 2 in a counterclockwise direction. Each developing device 2Bk–2Y preferably includes a developer-sleeve which rotates and brings the developing device into contact with a surface of the photoconductor 1 for developing the electrostatic latent image using toner, a developer-paddle which rotates to suck up and to agitate the developing device, and other components of developing devices. Toner in each of the developing devices 2Bk–2Y is charged with negative electricity through churning with a ferrite-carrier. Further, each developer-sleeve is connected to a bias power source (not shown) which generates a negative bias potential on which an oscillating potential is superimposed. As a result, each developer-sleeve is provided with a current having a negative DC component on which an oscillating component is superimposed. The voltage for each developer-sleeve with respect to a metal-base of the photoconductor 1 is controlled to be within a range that is predetermined for each developer-sleeve.

The first transfer unit 3 includes a plurality of rollers having a first transfer bias roller 3*a*, a belt driving roller 3*b*, a tension roller 3*c*, a second transfer opposing roller 3*d*, a cleaner opposing roller 3*e*, a ground roller 3*f*, and a first transfer belt 3*g* which is arranged to span and be tensioned around the plurality of rollers 3*a*–3*f*. When the belt driving roller 3*b* is driven by a driving motor (not shown), the first transfer belt 3*g* of the first transfer unit 3 rotates in a clockwise direction indicated by an arrow B in FIG. 1. The first transfer belt 3*g* may have either a mono-layered structure or a multi-layered structure, which may include a semi-conducting material and/or an insulating material.

When a toner image is transferred from the photoconductor 1 through a first transfer region 7, a transfer-bias voltage is applied to the first transfer bias roller 3*a* using a first transfer power source 8 which is controlled so that the bias voltage or the current has a desired value that is based on the number of overlaid toner images. In addition, a belt-discharge brush 19 which is biased with a ground potential abuts an inside surface of the first transfer belt 3*g* in the first transfer region 7, in order to discharge the first transfer region 7.

Further, a nip between the photoconductor 1 and the first transfer belt 3*g* is defined by moving a portion of the first transfer belt 3*g*, which is stretched between the first transfer bias roller 3*a* and the ground roller 3*f*, against a surface of the photoconductor 1. As a result, the first transfer region 7 transferring a toner image from the photoconductor 1 to the first transfer belt 3*g* is defined by bringing the portion of the first transfer belt 3*g* into tight contact with the surface of the photoconductor 1.

Further, each of the plurality of rollers 3*b*–3*f* is preferably made of a material having electrical conductivity, and is connected to a ground potential except for the first transfer bias roller 3*a*. A belt cleaning brush 15 disposed in contact with a surface of the first transfer belt 3*g* on the cleaner opposing roller 3*e*, a cleaning-blade (not shown), and a lubricant coating brush 5*a* near the cleaning-blade are respectively provided for the first transfer belt 3*g*. The cleaning-blade and the lubricant coating brush 5*a* are configured to be capable of both being brought into contact with and separated from the first transfer belt 3*g*, and are controlled to be brought into contact with the surface of the first transfer belt 3*g* with a desired timing. The lubricant coating brush 5*a* abrades a lubricant plate 5*b* including zinc stearate, and coats the abraded zinc stearate microparticles onto the surface of the first transfer belt 3*g*.

The second transfer unit 4 includes a second transfer belt 4*d* which is arranged to span and be tensioned around three supporting rollers 4*a*–4*c*. One of the three supporting rollers 4*a*–4*c* operates as a driving roller that drives the second transfer belt 4*d*. When the driving roller is driven by a driving motor (not shown), the second transfer belt 4*d* is rotated in a counterclockwise direction indicated by an arrow C in FIG. 1. In this preferred embodiment, the second transfer belt 4*d* is preferably designed to have a length that is substantially half of the first transfer belt 3*g*.

The second transfer unit 4 has a contact/separate mechanism which is capable of bringing the second transfer belt 4*d* into/out of contact with the first transfer belt 3*g*. As indicated by a chain double-dashed line of FIG. 1, the supporting roller 4*a* illustrated in the right hand portion of the FIG. 1 and a second transfer bias roller 4*e* for the second transfer, are installed so that they can move freely in both upward and downward directions. These rollers 4*a* and 4*e* can move with a desired timing using a driving mechanism (not shown).

When the supporting roller 4*a* and the second transfer bias roller 4*e* move in an upward direction using such a contact/separate mechanism, the second transfer belt 4*d* that is stretched between the supporting rollers 4*a* and 4*c* is pressed against a portion of the first transfer belt 3*g* that is on a circumferential surface of the second transfer opposing roller 3*d* of the first transfer unit 3, thereby a nip portion is formed. Accordingly, a second transfer region 10 is formed by nipping the first transfer belt 3*g* and the second transfer belt 4*d* between the second transfer opposing roller 3*d* and the second transfer bias roller 4*e*.

In a downstream region of the second transfer belt 4*d*, which is illustrated in a left portion of FIG. 1, a transfer sheet discharger 12 located above the supporting roller 4*c* and a belt-discharger 13 located below the supporting roller 4*c* are disposed so as to be opposite each other. A cleaning blade 14 is disposed opposite to the supporting roller 4*b* in a middle portion below the second transfer belt 4*d* so as to abut against the second transfer belt 4*d* to thereby nip the second transfer belt 4*d*.

When the electric charge applied to the transfer sheet P on the second transfer belt 4*d* is removed therefrom using the transfer sheet discharger 12, the transfer sheet P is separated from a surface of the second transfer belt 4*d* according to the rigidity of the transfer sheet P. The belt-discharger 13 discharges the surface of the second transfer belt 4*d*, from which the transfer sheet P has been separated, then the cleaning blade 14 removes any residual materials that remain attached on the surface of the second transfer belt 4*d*.

It should be noted that the first transfer belt 3*g* and the second transfer belt 4*d* preferably have a mono-layer structure and are preferably formed of at least one of the following materials including PVDF (polyvinyliden fluoride) resin, ETFE (ethylene/polytetrafluoroethylene) resin, polycarbonate resin, polyamide resin and other suitable similar material.

The first transfer belt 3*g* and/or the second transfer pelt 4*d* may also have another structure such that the belt 3*g* or belt 4*d* includes an elastic layer, such as a rubber layer and reinforcement fibers for reinforcing the elastic layer. The hardness of such an elastic layer relative to a thickness direction thereof is preferably of such a value that deficiencies in transfer quality, such as toner falling off from an interior portion of a toner image and other problems, do not occur. In addition, when insulating fibers are included, an interval between the insulating fibers preferably has a desired value, for example, in a range of about 0.05 mm to about 2 mm, so that the belt 3*g* or 4*d* has a predetermined, desired electric conductivity for an electrostatic process.

Next, operation of the image forming apparatus as described above will be explained. Hereinafter, we assume an exemplary sequences of developing color toner images, which starts with forming a Bk image, followed by forming a C image, an M image, and a Y image in sequence. In addition, the sequence in general is not restricted to this exemplary sequence.

When the copying operation starts, according to the command of copy-start, the photoconductor 1 is driven by a motor (not shown) to rotate in a direction directed by the arrow A in FIG. 1. Further, the first transfer belt 3*g* of the first transfer unit 3 is driven by the belt driving roller 3*b* to rotate in a direction directed by the arrow B in FIG. 1, with the same circumferential speed as the photoconductor 1.

At the time when these rotations of the photoconductor 1 and the first transfer belt 3*g* have just started, the second transfer unit 4 is at rest in a standby state and is stopped at a position below the first transfer belt 3*g* using the contact/separate mechanism. Further, when the image forming apparatus is in a standby state, the developing device Bk of revolver-developer device 2 is stopped at a home position for developing.

A reading operation for the Bk image starts at a predetermined timing using the color scanner. Subsequently, the writing operation, which utilizes a laser beam emitted from the optical writing unit (not shown), starts to form a latent image onto a surface of the photoconductor 1 corresponding to the obtained image data. Hereinafter, an electrostatic latent image that is formed on the basis of the Bk image data is referred to as a Bk latent image. A C latent image, an M latent image, and a Y latent image are also referred to in a similar manner. Because the developing starts from the front edge of the Bk latent image, the developer-sleeve starts its rotation so as to be ready for developing the Bk latent image with toner, before the front-edge of the Bk latent image arrives at the developing position. Then, the developing operation lasts until the rear-edge of the Bk latent image passes by the developing position of the Bk latent image. After this developing operation has finished, the developer device 2 quickly rotates and switches its position from the developing position of the Bk latent image to that of the C latent image, for the subsequent C latent image developing operation. This is completed, before the front-edge of the C latent image that is formed on the basis of the C image data arrives in the developing position.

Next, the Bk toner image, which is formed on the surface of the photoconductor 1, is transferred to a surface of the first transfer belt 3*g*, through the first transfer region 7 (hereinafter a transferring operation of a toner image from the photoconductor 1 to the first transfer belt 3*g* is referred to as a first transfer). The first transfer is performed such that the photoconductor 1 is kept in contact with the first transfer belt 3*g* under a transfer bias-field that is generated by applying a voltage to the first transfer bias roller 3*a*. Further, four toner images of Bk, C, M and Y, which are sequentially formed on the photoconductor 1, are respectively overlaid on the same surface of the first transfer belt 3*g*, under the control of precise positioning for the respective images, thereby a four-color first transfer toner image is formed.

Subsequent to the Bk process for the photoconductor 1, the photoconductor 1 proceeds to the next process for the C latent image. The reading process for the C image starts with a desired timing using the color scanner, then the process of writing the C latent image starts when the writing optical unit emits a laser beam for writing the C latent image corresponding to the image data obtained by the color scanner. The developer device 2 starts to rotate at a time after a rear portion of the Bk latent image has passed by the developing region, so that the rotation is finished before the C latent image arrives in the developing region, then the developer device 2 develops the C latent image with C toner.

The process of developing the C latent image lasts until a rear edge of the C latent image passes by the developing region, then the developing device 2C starts to be rotated so that the rotation is finished before a front edge of the next M latent image arrives at the developing region. Further explanation of the processes for the M-image and the Y image is abbreviated, because respective processes of reading, forming latent images, and developing, are similar to those for the Bk and C latent images.

Before the first transfer to the first transfer unit 3 is completed, the second transfer unit 4 starts to be rotated with a desired timing. Then, formation of the second transfer region 10 between the first transfer unit 3 and the second transfer unit 4 is completed using the contact/separate mechanism, before a front edge of the four color first transfer toner image on the first transfer unit 3 arrives at the second transfer region 10.

The transfer sheet P is supplied through a sheet supply unit 105 such as a transfer sheet cassette or a manual paper feeding tray at approximately the same time when the above-mentioned image forming operation is performed, and the transfer sheet P stops in a standby state at a nip between a pair of registration rollers. The pair of registration rollers is then driven with a timing such that the front edge of the transferred toner image on the first transfer belt 3*g* is accurately overlaid with a predetermined position equal to or near the front edge of the transfer sheet P. The transfer sheet P with adjusted registration is transferred to the second transfer region 10, as shown in FIG. 1.

When the transfer sheet P passes by the second transfer region being overlaid on the four-color toner image of the first transfer belt 3*g*, the four-color toner image, as a whole, is transferred to the transfer sheet P by a transfer bias electric field generated by the bias voltage applied to the second transfer bias roller 4*e*. The transfer sheet P, which includes the thus transferred whole four-color toner image thereon accompanied by electric charges, is brought into tight contact with the second transfer belt 4*d*, and is forwarded toward the fixing unit 5 having a pair of fixing rolers. When the transfer sheet P passes by a region facing the transfer sheet discharger 12 which is disposed in the downstream position of the feeding direction of the transfer sheet P, the transfer sheet P is discharged. Then the transfer sheet P is separated from the second transfer belt 4*d* to be forwarded to the fixing unit 5. The toner image on the transfer sheet P, which is thus forwarded thereto, is fused to be fixed at a nip between a pair of fixing rollers of the fixing unit 5. Then the transfer sheet P is fed out of the main body of the image forming apparatus to be stacked on a tray for sheets (not shown), thereby a full-color copy image is formed on the transfer sheet P.

Further, a surface of the photoconductor 1 is cleaned after the first transfer using the photoconductor cleaning unit 1*a*, and is discharged uniformly using the discharge lamp 1*b*.

In addition, residual toner remaining on a surface of the first transfer belt 3*g* is removed from the surface using a belt-cleaning blade (not shown) and the belt cleaning brush 15.

When a repeated copying operation is performed, after the process of forming the Y latent image of the first sheet of paper, the operation of the color scanner and the image forming operation of the photoconductor 1 proceed to respective operations with appropriate timings for forming a Bk latent image which corresponds to a first toner image for the next transfer sheet P. As to the first transfer succeeding the second transfer of the above-mentioned four-color toner image to tie first transfer sheet P, the Bk toner image for the next transfer sheet P is transferred to a surface of the first transfer belt 3*g* which has been completely cleaned using the above-mentioned cleaning blade or other cleaning devices. Subsequently, the process proceeds in a similar manner to that for the first transfer sheet P.

The above-explanation is for an operation for forming four-color or full color images. However, it should be noted that the present invention is also applicable to mono-color image forming processes and 2, 3 or n-color forming processes, where n is an integer. An operation for two-color or three-color images is similar to that for the four-color images, wherein the transfer process for overlaying the toner images continues for a desired number of toners and desired times for repeated copying processes.

As to the operation for mono-color images, the copying process continues successively in a state such that one of the developing devices 2Bk–2Y which corresponds to a desired color is held at a predetermined position, being always active for the developing process until the processes for a desired number of transfer sheets have been completed. In this case, the above-mentioned belt-cleaning blade is pressed against the first transfer belt 3*g* during the series of copying operations.

As described above, the first transfer unit 3 and the second transfer unit 4 of the image forming apparatus have a structure such that the transfer belts 3*g* and 4*d* are respectively spanned and tensioned around the plurality of rollers. Therefore, when the belts 3*g*, 4*d* remain in a standby state for a long period of time, respective portions of the belts 3*g*, 4*d*, which have stopped on the circumferential surfaces of the plurality of rollers are deformed due to plastic deformation. The belt portions deformed due to plastic deformation are respectively located along the belts according to the arrangement of the plurality of rollers. Therefore, the positions of the respective deformed portions change in a general case when the arrangement of the rollers varies.

Because the first transfer belt 3*g* of the first transfer unit 3 according to this preferred embodiment is stretched with high-tension by the plurality of rollers 3*a*–3*f*, the portions of the first transfer belt 3*g* that have been kept in contact with the circumferential surfaces of the plurality of rollers are deformed via plastic deformation, thereby the deformed portions 3*a*'–3*f*' are produced. Hereinafter, any one of reference numerals 3*a*'–3*f*', which includes an apostrophe on a right side of the reference numerals 3*a*–3*f*, denotes a portion of the first transfer belt 3*g* which is deformed via plastic deformation through contact with a roller that is designated by the corresponding reference numeral. For example, reference numeral 3*a*' denotes a portion of the first transfer belt 3*g* that is deformed via plastic deformation through contact with the circumferential surface of the roller 3*a*, for a long period of time. Hereinafter, other portions of the belt 3*g* which are deformed via plastic deformation are referred to using similar reference numerals.

The second transfer belt 4*d* of the second transfer unit 4 according to this preferred embodiment is also stretched with high-tension by the rollers 4*a* and 4*c*. After the second transfer belt 4*d* has been kept in contact with the circumferential surfaces of the plurality of rollers for a long period of time, the portions 4*a*' and 4*c*' are also deformed due to plastic deformation.

As mentioned above, the deformed portion 4*a*' corresponds to a portion of the second transfer belt 4*d* that has been kept in contact with a circumferential surface of the supporting roller 4*a*, and the deformed portion 4*c*' corresponds to a portion that has been kept into contact with a circumferential surface of the supporting roller 4*c*. However, the effect of the plastic deformation caused by the supporting roller 4*b* is not taken into account in this discussion, because the supporting roller 4*b* is provided at a position such that the supporting roller 4*b* does not bend the second transfer belt 4*d* significantly, thereby the plastic deformation may not be caused through contact with the supporting roller 4*b*.

If one of the deformed portions 3*a*'–3*f*' of the first belt 3*g* and one of the deformed portions 4*a*' and 4*c*' of the second belt 4*d* overlap each other at the second transfer region 10, then image quality is greatly deteriorated in a portion of the image that has been transferred through such an overlapped portion. This is because tight contact in the second transfer region 10 is easily prevented in such a case due to the deformed portions 3*a*'–3*f*' being overlapped with respective deformed portions 4*a*' and 4*c*'.

To overcome the above problems caused by plastic (deformation of the plurality of belts, the first transfer unit 3 and the second transfer unit 4 according to this preferred embodiment are configured to have respective specific structures as explained below. Further, the image forming apparatus according to this preferred embodiment, drives the first transfer unit 3 and the second transfer unit 4 according to a precise timed control as explained later.

The first transfer unit 3 and the second transfer unit 4 preferably include respective detectors 6 and 9 for detecting respective positions and controlling the drive thereof.

The detector 6 for detecting the position of the first transfer belt 3*g* includes, for example, a detection mark 6*a* which indicates a datum position of the first transfer belt 3*g* and an optical sensor 6*b* which detects the detection mark 6*a*. A reflection type sensor or a transmission type sensor may be used for the detector 6. In this preferred embodiment, a thin reflecting member 6*a* (hereinafter referred to as a detection mark 6*a*) is adhered on an inner surface of the first transfer belt 3*g*, and a reflective-type photo-sensor 6*b* (hereinafter referred to as an optical sensor 6*b* ) is disposed opposite to the inner surface of the first transfer belt 3*g* so as to detect the detection mark 6*a* which passes by the optical sensor 6*b* during operation.

In this case, reflectivity of the detection mark is different from that of the inner surface of the first transfer belt 3*g*, thereby, when the detection mark 6*a* passes by the optical sensor 6*b*, the optical sensor 6*b* detects a change in reflectivity. More specifically, the change in reflectivity measured is, for example, a reflectivity from a surface having low reflectivity compared to reflectivity of another surface having high reflectivity, or another from a surface having high reflectivity to that from still another surface having low reflectivity. Further, a plurality of detection marks may be used.

Alternatively, a transmission type photo-sensor may be used. In this case, a hole, for example, is formed in a desired portion of the first transfer belt 3*g* which is not used for the transfer region. The transmission-type photo-sensor is located so as to detect a transmitted light flux through the hole.

The detector 9 for detecting a position of the second transfer belt 4*d* includes a detection mark 9*a* which indicates a datum position for the second transfer belt 4*d* and an optical sensor for detecting the detection mark 9*a*. The detection mark 9*a* may be similar to the detector 6 for the first transfer unit 3. The detector 9 may include either a reflection type sensor or a transmission type sensor. In this preferred embodiment, a reflective detection mark 9*a* is adhered on an inner surface of the second transfer belt 4*d*, and a reflector-type optical sensor 9*b* is disposed opposite to the inner surface of the second transfer belt 4*d* so that the detection mark 9*a* can pass by the optical sensor 9*b*.

The first transfer unit 3 and the second transfer unit 4 which respectively have the detectors 6 and 9, are controlled to stop at respective appropriate timings such that the first transfer belt 3*g* and the second transfer belt 4*d* stop at respective predetermined, desired positions, when the first transfer unit 3 and the second transfer unit 4 are controlled to stop operation for image forming. As a result, the first transfer belt 3*g* and the second transfer belt 4*d* stop at the same respective desired positions each time the transfer units 3, 4 are stopped.

In this preferred embodiment, the rotation of the first transfer belt 3*g* stops at a desired predetermined timing after the detection mark 6*a* of the first transfer belt 3*g* is detected. Also, the rotation of the second transfer belt 4*d* stops at a desired predetermined timing after the detection mark 9*a* of the second transfer belt 4*d* is detected. In this case, the desired predetermined timing for the first transfer belt 3*g* is set so that the detection mark 6*a* stops at a location opposite to the optical sensor 6*b*, as shown in FIG. 1. Further, the desired, predetermined timing for the second transfer belt 4*d* of the second transfer unit 4 is set so that the detection mark 9*a* stops at a fixed position near the lower part of the supporting roller 4*c*, as illustrated in the left-hand portion of FIG. 1.

With the above-described control for stopping the first transfer unit 3 and the second transfer unit 4, the first transfer belt 3*g* and the second transfer belt 4*d* always stop at the same positions, respectively. Therefore, deformed portions 3*a*'–3*f*' and 4*a*' and 4*c*' are made in portions of the belts which always stop on the same circumferential surfaces of the rollers 3*a*–3*f*, 4*a* and 4*c*. During a time when the first transfer belt 3*g* and the second transfer belt 4*d* are rotating, the respective positions of the deformed portions can be determined using a calculation on the basis of the velocity of the belts and the latest time when the detection mark 6*a* or the detection mark 9*a* has been detected.

Figure 2:
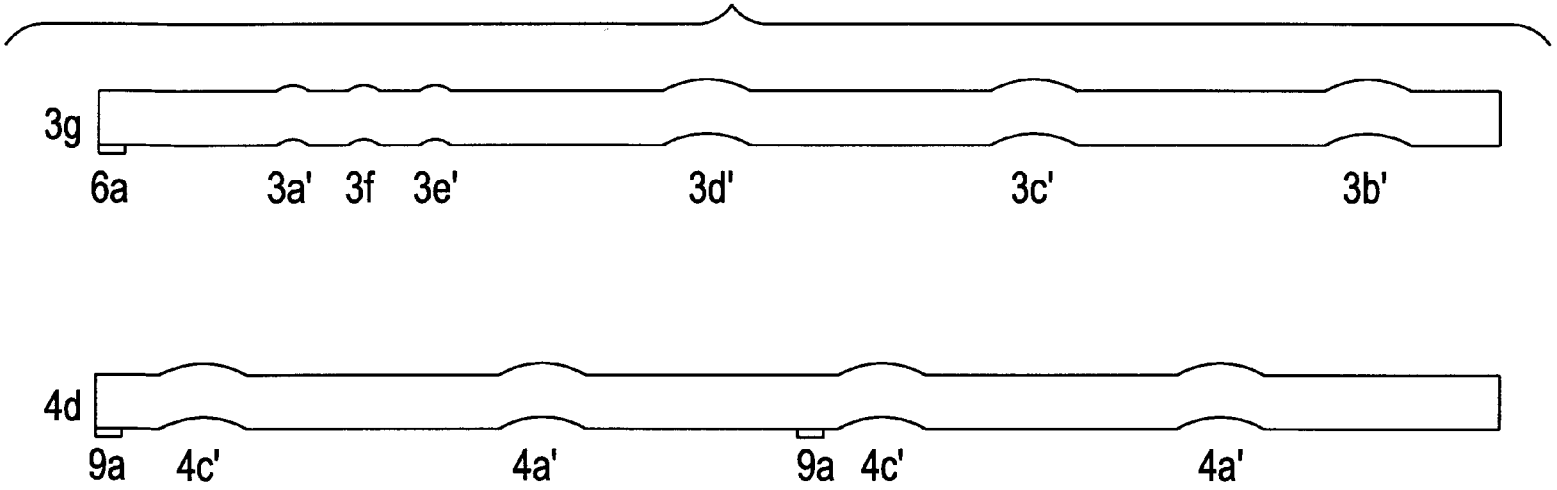
FIG. 2 is a schematic diagram illustrating respective positions of the deformed portions formed in the first transfer belt and the second transfer belt.

FIG. 2 is a schematic diagram illustrating respective positions of the deformed portions formed in the first transfer belt 3*g* and the second transfer belt 4*d*. In FIG. 2, respective belts are illustrated in such a way to facilitate the comparison between the belts. More specifically, the first transfer belt 3*g* and the second transfer belt 4*d* are cut open at respective positions near the detection marks 6*a* and 9*a*, and are extended lengthwise, respectively. The first transfer belt 3*g* having an endless shape is cut at a point indicated by an arrow D of FIG. 1, and then extended lengthwise. The second transfer belt 4*d* having an endless shape is cut at a point indicated by an arrow E of FIG. 1, and then extended lengthwise. In addition, another second transfer belt having the same structure is connected together, as illustrated in FIG. 2, so that the comparison between the two belts can be made with respect to the whole length of the first transfer belt 3*g*. The detection mark 6*a* of the first transfer belt 3*g* and the first detection mark 9*a* of the connected second transfer belt 4*d* at respective edges are shown on the leftmost side in FIG. 2.

As mentioned above, the total circumferential length 3L of the first transfer belt 3*g* is preferably constructed to be substantially equal to twice the total circumferential length 4L of the second transfer belt 4*d*. Further, the deformed portions 3*a*'–3*f*' do not overlap the deformed portions 4*a*' and 4*c*', when they are adjusted so that the detection mark 6*a* coincides with the detection mark 9*a*. Therefore, arrangement of the plurality of rollers 3*a*–3*f*, around which the first transfer belt 3*g* is spanned and tensioned, and the plurality of rollers 4*a* and 4*c*, around which the second transfer belt 4*d* is spanned and tensioned, is designed so that the deformed portions of one belt are respectively positioned in intervening portions between the deformed portions of the other belt.

Because the first transfer belt 3*g* and the second transfer belt 4*d* are controlled to rotate at substantially the same circumferential speed, the second transfer belt 4*d* rotates in exactly two cycles in contrast to the rotation of the first transfer belt 3*g* of one cycle. Therefore, the positional correspondence between the first transfer belt 3*g* and the second transfer belt 4*d* is maintained throughout the rotations, in which none of the deformed portions 3*a*'–3*f*' is brought into contact with the deformed portions 4*a*' and the 4*c*' in the second transfer region 10.

In one mode of operating the image forming apparatus, the first transfer unit 3 starts rotating first, then the second transfer unit 4 starts rotating about a timing such that the transfer of the toner image from the photoconductor 1 to the first transfer unit 3 has been completed. Further, after the circumferential speed of the second transfer belt 4*d* is reached at the same speed as the first transfer belt 3*g*, the second transfer region 10 is established using the contact/separate mechanism, which brought the second transfer belt 4*d* into contact with the first transfer belt 3*g*.

In this mode of operation, the second transfer unit 4 is required to start rotating with a specific timing which is determined on the basis of detected signals of the detection mark 6*a* of the first transfer unit 3, such that the deformed portions 3*a*'–3*f*' do not overlap the deformed portions 4*a*' and 4*c*' in the second transfer region 10.

Figure 3:
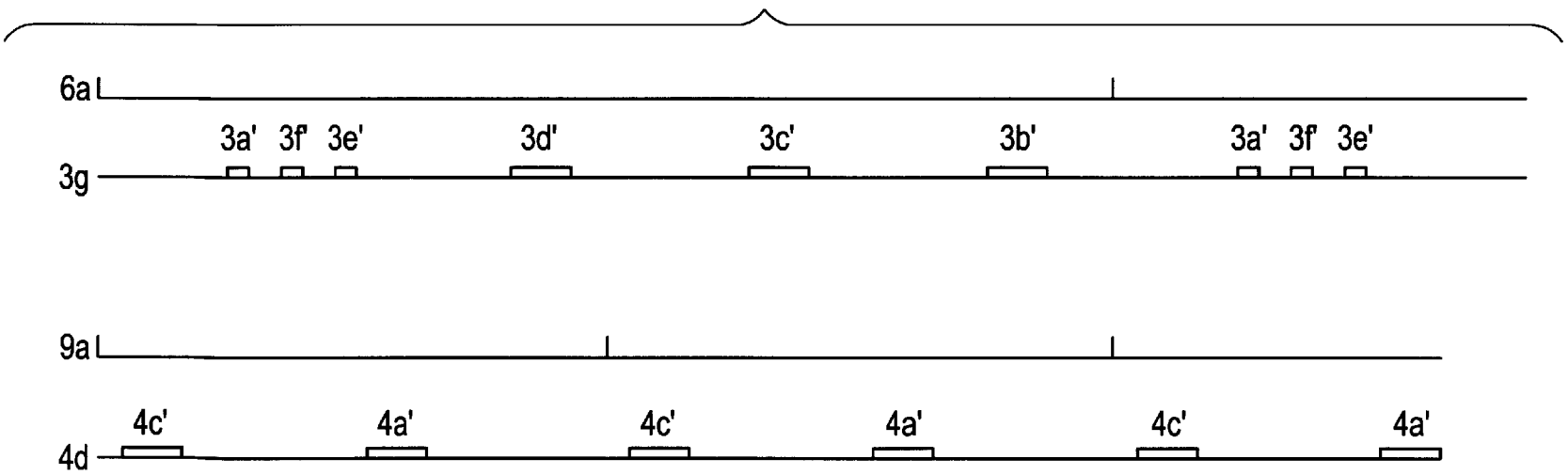
FIG. 3 is a timing chart for the first and the second transfer belts during rotation in one mode of operation.

FIG. 3 is a timing chart of the first transfer belt 3*g* and the second transfer belt 4*d*. A series of timings, which indicate timings when the detection mark 6*a*, the detection mark 9*a*, the deformed portions 3*a*'–3*f*' and the deformed portions 4*a*' and 4*c*' respectively pass the second transfer region 10, is illustrated.

The timing for starting rotation of the second transfer belt 4*g* is controlled so that the timing of the detection mark 9*a* passing by the second transfer region 10 coincides with that of the detection mark 6*a*, within a period of time when the first transfer belt 3*g* rotates in about one cycle. Thereafter, both of the first transfer belt 3*g* in rotation and the second transfer belt 4*d* in rotation are brought into contact with each other in the second transfer region 10, maintaining the positional correspondence as shown in FIG. 3. Therefore, the deformed portions 3*a*'–3*f*' do not overlap the deformed portions 4*a*' and the 4*c*' as shown in FIG. 2, thereby image quality deterioration is prevented with this mode of operation, which deterioration otherwise emerges when the deformed portions are overlapped each other.

Although the mode of operation is explained on the basis of the correspondence between the detection mark 6*a* and the detection mark 9*a* in the above explanation, the mode of operation in general is not restricted to such a correspondence. It is sufficient for a general mode of operation to satisfy a specific positional relationship between the detection mark 6*a* and the detection mark 9*a* related to a standstill state, which enables the mode of operation in which no deformed portions overlap in the transfer region. Such a timing for driving the second transfer unit 4 is generally determined on the basis of the position of the first transfer belt 3*g* during rotation, the position of the first transfer belt 3*g* which is standing still, and the position of each deformed portion.

There accordingly has been described an image forming apparatus which includes a combination of a first transfer unit and a second transfer unit. Another preferred embodiment according to the present invention is also possible, which includes a combination of an image bearing member having a belt spanned and tensioned around a plurality of rollers and an Intermediate transfer unit having a belt. In this case, the image bearing member and the intermediate transfer unit can be explained with respective similar contexts as the first transfer unit 3 and the second transfer unit 4 and can have similar features and functioning thereof.

Numerous modifications and variations of the preferred embodiments disclosed herein are possible in light of the above teachings. It is therefore to be understood that within the scope the appended claims, the invention may be practiced otherwise than as specifically described herein.

This document is based on Japanese Patent Application No. 10-196523/1998 filed in the Japanese Patent Office on Jun. 29, 1998, the entire contents of which are hereby incorporated by reference.

What is claimed is:

1. An image forming apparatus comprising:

an image writing device including a photoconductor halving latent image formed thereon and developer for developing the latent image into a toner image on the photoconductor;

a first transfer unit including a first plurality of rollers and a first transfer belt tensioned around the first plurality of rollers and arranged to receive the toner image from the photoconductor in a first transfer region;

a second transfer unit including a second plurality of rollers and a second transfer belt tensioned around the second plurality of rollers and arranged to contact the first transfer belt to receive the toner image from the photoconductor in a second transfer region and transfer the toner image onto a sheet; and a driving control unit arranged to drive the first transfer belt and the second transfer belt such that deformed portions of the first transfer belt and the second transfer belt which have been deformed due to plastic deformation caused by contact with at least one of the plurality of rollers of the first and second transfer units respectively, do not contact each other at the second transfer region.

2. The apparatus according to claim 1, wherein the driving control unit controls the movement of the first transfer belt and the second transfer belt such that when a deformed portion in the first transfer belt is located at the second transfer region, a deformed portion in the second transfer belt is spaced from the second transfer region.

3. The apparatus according to claim 1, wherein the first transfer belt and the second transfer belt are arranged to contact each other at a nip in the second transfer region.

4. The apparatus according to claim 1, further comprising nip rollers disposed at the second transfer region, the nip rollers being arranged to contact each other with the first and second transfer belts disposed therebetween.

5. The apparatus according to claim 1, wherein the first transfer unit and the second transfer unit include respective detectors for detecting respective positions of the first transfer belt and the second transfer belt and arranged to transmit information about the respective positions of the first transfer belt and the second transfer belt to the driving control unit for controlling the drive of the first and second transfer belts.

6. The apparatus according to claim 5, wherein the detectors include a detection mark arranged to indicate a datum position of the first transfer belt or the second transfer belt and an optical sensor which detects the detection mark.

7. The apparatus according to claim 5, wherein the detectors include one of a reflection type sensor and a transmission type sensor and a detection mark arranged to indicate a datum position of the first transfer belt or the second transfer belt.

8. The apparatus according to claim 1, wherein the driving control unit controls the first transfer unit and the second transfer unit to stop the first transfer belt and the second transfer belt at the same respective predetermined, desired positions such that a deformed portion of the first transfer belt is not in contact with deformed portion of the second transfer belt at the second transfer region.

9. The apparatus according to claim 1, wherein the first and second transfer belts are controlled to stop at the same positions, respectively and such that deformed portions in the first and second transfer belts always stop on the same circumferential surfaces of the rollers of the first and second transfer units.

10. The apparatus according to claim 1, wherein the first plurality of rollers of the first transfer unit includes a first transfer bias roller, a belt driving roller, a tension roller, a second transfer bias roller, a cleaner opposing roller, and a ground roller.

11. The apparatus according to claim 10, wherein each of the plurality of rollers of the first transfer unit is made of a material having electrical conductivity and is connected to a ground potential except for the first transfer bias roller.

12. The apparatus according to claim 1, wherein the second transfer unit has three supporting rollers including a driving roller arranged to drive the second transfer belt.

13. The apparatus according to claim 1, wherein at least one of the first transfer belt and the second transfer belt has one of a mono-layer structure and a multi-layered structure made of at least one of a semi-conducting material and an insulating material.

14. The apparatus according to claim 1, wherein at least one of the first transfer belt and the second transfer belt have a mono-layer structure and at least one of the first transfer belt and the second transfer belt are formed of at least one of PVDF resin, ETFE resin, polycarbonate resin, and polyamide resin.

15. The apparatus according to claim 1, wherein at least one of the first transfer belt and the second transfer belt includes an elastic layer and reinforcement fibers reinforcing the elastic layer.

16. The apparatus according to claim 15, wherein an interval between the reinforcement fibers is in the range of about 0.05 mm to about 2 mm.

17. The apparatus according to claim 1, wherein the second transfer belt has a length that is substantially half of the length of the first transfer belt.

18. The apparatus according to claim 1, wherein the second transfer unit includes a contact/separate mechanism which is arranged to move the second transfer belt into contact with and out of contact with the first transfer belt.

19. The apparatus according to claim 18, wherein the second transfer unit includes a supporting roller and a transfer bias roller, and the supporting roller and the second transfer bias roller are arranged to move upward and downward directions via the contact/separate mechanism such that when the supporting roller and the transfer bias roller move in an upward direction, the second transfer belt is pressed against a portion of the first transfer belt to thereby define a nip portion at which toner images are transferred from the first transfer belt to the second transfer belt.

20. The apparatus according to claim 1, wherein the image writing device is a mono color image writing device.

21. The apparatus according to claim 1, wherein the image writing device is a multiple color image writing device.

22. An image forming apparatus comprising:

an image writing device including a photoconductor having latent image formed thereon and developer for developing the latent image into a toner image on the photoconductor;

a first transfer unit including a first plurality of rollers and a first transfer belt tensioned around the first plurality of rollers and arranged to receive the toner image from the photoconductor in a first transfer region;

a second transfer unit including a second plurality of rollers and a second transfer belt tensioned around the second plurality of rollers and arranged to contact the first transfer belt to receive the toner image from the photoconductor in a second transfer region and transfer the toner image onto a sheet; and a driving control unit arranged to sense a condition of at least one of the first and second transfer belts and to drive the first transfer belt and the second transfer belt based on such sensed condition.

23. The apparatus according to claim 22, wherein the condition sensed by the driving control unit is sensing deformed portions of the first transfer belt and the second transfer belt which have been deformed due to plastic deformation caused by contact with at least one of the plurality of rollers of the first and second transfer units.

24. The apparatus according to claim 22, wherein the driving control unit controls the movement of the first and second transfer belts such that a deformed portion of the first transfer belts does not contact a deformed portion of the second transfer belt in the second transfer region.

* * * * *